United States Patent [19]

Raganato et al.

[11] 4,025,593

[45] May 24, 1977

[54] FABRICATION OF DISCONTINUOUS FIBRILS

[75] Inventors: Carlo Raganato, Castiglioncello, Italy; Georges Voituron, Vilvoorde, Belgium

[73] Assignee: Solvay & Cie, Brussels, Belgium

[22] Filed: June 9, 1975

[21] Appl. No.: 585,441

Related U.S. Application Data

[63] Continuation of Ser. No. 277,033, Aug. 1, 1972, abandoned.

[30] Foreign Application Priority Data

Aug. 6, 1971 Luxembourg ..... 63673

[52] U.S. Cl. ..... 264/94; 162/157 R; 264/12; 264/141; 528/483; 528/502

[51] Int. Cl.[2] ..... B29C 17/06

[58] Field of Search ..... 264/196 F, 12, 141, 264/94; 162/157 R; 260/94.9 G, 94.9 D, 94.9 F; 528/483, 502

[56] References Cited

UNITED STATES PATENTS

| | | | |
|---|---|---|---|
| 2,297,726 | 10/1942 | Stephanoff | 34/10 |
| 2,728,753 | 12/1955 | Russum et al. | 260/94.9 |
| 2,831,845 | 4/1958 | Biddle et al. | 260/94.9 P |
| 2,967,327 | 1/1961 | Ladisch | 65/5 |
| 3,227,794 | 1/1966 | Anderson et al. | 264/205 |
| 3,549,732 | 12/1970 | Rice | 264/143 |
| 3,719,648 | 3/1973 | Frielink | 260/85.5 R |
| 3,740,383 | 6/1973 | Gabellieri et al. | 260/88.2 |
| 3,883,630 | 5/1975 | Raganato | 264/204 |
| 3,885,014 | 5/1975 | Fukada et al. | 264/176 F |
| 3,920,362 | 11/1975 | Bradt | 425/72.5 |

FOREIGN PATENTS OR APPLICATIONS

| | | | |
|---|---|---|---|
| 1,124,578 | 8/1968 | United Kingdom | 264/184 |

*Primary Examiner*—Jay H. Woo
*Attorney, Agent, or Firm*—Spencer & Kaye

[57] ABSTRACT

A continuous fibrillated structure, formed by the abrupt pressure release of a two-phase liquid mixture of polymer and solvent at elevated temperature and pressure so as to cause the instantaneous vaporization of the solvent, is shredded by introducing a make-up fluid into the two-phase liquid mixture before the pressure release is complete.

13 Claims, 4 Drawing Figures

FABRICATION OF DISCONTINUOUS FIBRILS

CROSS REFERENCE TO RELATED APPLICATION

This application is a continuation of application Ser. No. 277,033, filed Aug. 1, 1972, now abandoned.

BACKGROUND OF THE INVENTION

The present invention relates to a process for the manufacture of discontinuous fibrils by the abrupt release of pressure on a two-phase liquid mixture of molten polymer and solvent which is under elevated pressure and at elevated temperature.

It is well known that one can produce continuous fibrillated structures or rovings by similar processes. For example, in U.S. Pat. No. 2,372,695, issued May 15, 1940, and assigned to Celanese Corp. of America there is a description of the production of a downy mass formed of very fine filaments connected with one another by bringing about an abrupt pressure release through an appropriate orifice of a solution of a cellulose derivative which is at elevated temperature and pressure.

According to Belgian Pat. No. 568,524 of June 11, 1958, in the name of E. I. Du Pont de Nemours, continuous structures consisting of a multitude of fibrillous strands or sections, which come together and separate at random intervals to form a "unit fibrillous plexus", are obtained by extruding a solution of synthetic polymer, which is at a temperature higher than the normal boiling point of the solvent and under autogenous pressure or under a higher pressure, through an orifice of suitable shape into a zone of lower pressure.

The fibrillated structures obtained according to the processes described above take the form of continuous rovings. Moreover, as is stated in Belgian Pat. No. 568,524, these structures are produced at a very high speed (which may reach as much as 13,700 m/min), which makes it impossible to cut them up by mechanical means.

The subsequent processing of these continuous rovings produced at very high speed is very difficult. Moreover, for a large number of applications, it is essential to use the fibrillated products in a shreaded form, that is to say in the form of discontinuous structures of relatively short length, for example of the order of a few millimeters. That is why, as can be seen from French Pat. No. 1,246,379 of Nov. 17, 1959, in the name of E. I. du Pont de Nemours, it is necessary to reduce the length of the continuous fibrillated rovings by a treatment in a grinding apparatus. This treatment is harmful to the physical qualities of fibrillated structures and calls for a supplementary operation which necessitates tying up large amounts of capital and requires a considerable amount of power.

It is apparent that a process of the type described above, but leading to the direct acquisition of short fibrils could in numerous cases permit a more economical and easier use of the products obtained and also improve their quality.

SUMMARY OF THE INVENTION

It is the object of the present invention to provide a process which will avoid the above-mentioned disadvantages. The present invention relates to a process for the manufacture of discontinuous fibrils in which the abrupt pressure release of a two-phase liquid mixture of molten polymer and solvent, which is at elevated temperature and pressure, brings about the instantaneous vaporization of the solvent and solidifies the polymer. According to the invention, a make-up fluid is introduced into the two-phase liquid mixture before the pressure release is complete.

By the designation "discontinuous fibrils" is meant elongated fibrillated structures consisting of very slender filaments, of a thickness of the order of a micron, connected with one another so as to form a three-dimensional network. These fibrils which are of a fluffy appearance generally have an elongated shape. Their length varies from 1 mm to about 5 cm and their diameter from about 0.01 to 5 mm. The specific surface area of these products is greater than 1 $m^2/g$. These fibrils are particularly suitable for the production by the usual methods of non-woven textiles and synthetic papers.

The process according to the invention may be carried out by using any polymer which is suitable for spinning. Among the polymers which can be used one may mention the polyolefins such as polyethylene, polypropylene, ethylene/propylene copolymers, polyisobutylene, etc., polyamides, polyesters, polyurethanes, polycarbonates, vinyl polymers such as polyvinyl chloride, which may also be postchlorinated, polyvinyl fluoride, acrylic polymers such as the homopolymers and copolymers of acrylonitrile, etc. This list is by way of example and is not restrictive.

Nevertheless, applicants prefer to use crystallizable polymers whose rate of crystallinity measured by X-ray diffraction is at least 10% and preferably at least 20% because the stretch to which these polymers are subjected, as a result of the action of vapors released during the abrupt pressure release, imparts to them an orientated structure which results in good mechanical properties.

Among these polymers, the polyolefins such as high-density polyethylene, isotactic polypropylene and isotactic poly-4-methylpentene-1 lead to the best results.

The solvent is preferably chosen according to the polymer used as well as the following criteria. The solvent must not dissolve more than 50 g/liter, and preferably not more than 10 g/liter, of polymer under normal conditions of temperature and pressure (20° C and 1 atmosphere). Moreover, it must possess at normal pressure a boiling point which is more than 20° C and preferably more than 40° C lower than the melting or softening point of the polymer used. Furthermore, it must permit the formation of a two-phase liquid mixture under operational conditions just prior to the abrupt pressure release.

Among the solvents which can be used one may mention the aliphatic hydrocarbons such as pentane, hexane, heptane, octane and their homologues and isomers, the alicyclic hydrocarbons such as cyclohexane, the aromatic hydrocarbons such as benzene, toluene, etc., the halogenated solvents such as the chlorofluoromethanes, methylene chloride, ethyl chloride etc., the alcohols, ketones, esters and ethers.

Applicants define below what is meant by the expression "two-phase liquid mixture".

When one subjects a mixture of suitable solvent and polymer, with a suitable concentration of polymer, to very elevated temperature and pressure, one observes that the mixture takes the form of a single homogeneous liquid phase. If then, while maintaining all the other conditions constant, one gradually reduces the pressure, one observes that, as from a certain pressure onwards, which varies according to the case, the solution of polymer becomes turbid because of the establishment of a system of two liquid phases consisting of a continuous liquid phase which is poor in polymer and in which there is dispersed, in the form of droplets, a second liquid phase which is rich in polymer. The value of the pressure at which this phenomenon makes its appearance may be determined experimentally.

In the process according to the invention it is therefore advisable to choose the pressure of the mixture which is subjected to the abrupt pressure release in such a way that it is present in the form of a two-phase liquid mixture. The same applies to the concentration of polymer and the temperature.

In practice one may prepare a solution with a single liquid phase at a higher pressure than that at which the formation of a two-phase liquid mixture takes place and then carry out a sufficient prior release of pressure to bring about the establishment of the system with two liquid phases.

The temperature of the two-phase liquid mixture subjected to abrupt pressure must be such that the latent heat stored by the solvent and the molten polymer is sufficient to bring about the complete vaporization of the solvent during the abrupt pressure release. This temperature must not however exceed a maximum value, otherwise the quantity of heat consumed by the vaporization of the solvent would be insufficient to bring about the solidification of the polymer. Furthermore, it must enable the apparatus to operate at a pressure at which the formation of the two-phase liquid mixture takes place. Finally, the temperature must be lower than the critical temperature of the solvent. Generally speaking, the temperature of the mixture is between 100° and 300° C and preferably between 125° and 250° C.

The concentration of polymer in the mixture used is also selected so as to permit a two-phase liquid mixture to be obtained. It may vary from 1 to 500 g/kg of mixture. However, applicants prefer to use mixtures containing from 10 to 300 g of polymer per kg of mixture and preferably 50 to 200 g/kg.

For each particular polymer, therefore, it is necessary to choose a solvent complying with the criteria defined above and then to determine the concentration of polymer, the pressure and the temperature of the mixture which is subjected to instantaneous pressure release. These parameters are therefore chosen not only so as to give a two-phase liquid mixture, but also so that the solvent vaporizes instantaneously and completely during the abrupt pressure release. These conditions are the same as those imposed on two-phase liquid mixtures used according to the prior art to manufacture continuous fibrillated rovings.

The two-phase liquid mixtures are subjected to an abrupt pressure release, that is to say their pressure is brought to a value close to atmospheric pressure, preferably to a pressure lower than 3 kg/cm$^2$ absolute, within a very short period of time, preferably less than 1 second. This pressure release may be brought about by passing the mixture through any device which is capable of creating high load losses, such as a diaphragm, a Venturi or a valve. However, it is preferable to use dies whose cylindrical orifices have a diameter of between 0.1 and 3 mm, and preferably between 0.3 and 1 mm, and a length/diameter ratio of between 0.1 and 10, and preferably between 0.5 and 2.

It is obvious that the two-phase liquid mixture used may also contain other usual additives for polymers such as stabilizers to the action of heat and light, reinforcing agents, fillers, pigments, antistatic agents, nucleation agents, etc.

The make-up fluid injected into the two-phase liquid mixture before the pressure release is complete may be of any kind and may be a gas, a vapor or a liquid.

However, it will be obvious that this fluid must not exert any harmful action on the continuous fibrillated structure produced by the abrupt pressure release of the mixture. In particular, the use of a fluid which exerts a solvent or swelling action on the polymer used at ambient temperature must be ruled out.

As has been stated above, the fluid used may be of any desired kind. In particular, applicants have obtained excellent results when this fluid was nitrogen, water vapor, water or an organic liquid. Applicants have also found that it is possible to use as fluid the solvent used to make the two-phase liquid mixture.

When the make-up fluid is water under pressure, applicants have found that it is advantageous to incorporate a wetting agent in it.

The pressure under which the make-up fluid is injected must obviously be higher than the pressure of the two-phase liquid mixture at the point of injection.

The make-up fluid may be at any desired temperature. This temperature is preferably selected so that the supply of calories to the two-phase liquid mixture cannot hinder the instantaneous vaporization of the solvent and the solidification of the polymer during the abrupt pressure release of the mixture.

This temperature is preferably between 20° C and the boiling point of the fluid at the working pressure, that is to say at its pressure of injection.

When the make-up fluid is a liquid, its temperature is preferably higher than its boiling point at the pressure of the pressure release chamber, that is to say the pressure obtained at the outlet from the abrupt pressure release orifice.

The ratio between the volume of make-up fluid and the volume of two-phase liquid mixture may vary between 0.3 and 10. However, applicants prefer this ratio to be from 0.7 to 5 and preferably from 1 to 3.

The make-up fluid may be injected into the two-phase liquid mixture either before the abrupt pressure release or during this release. In the former case, the make-up fluid is injected into the two-phase liquid mixture at a point situated before or upstream of the abrupt pressure release orifice. In the latter case, the make-up fluid is injected into the two-phase liquid mixture during its passage through the pressure release orifice.

The residence time of the make-up fluid in the pressure release device is preferably less than 2 seconds. The best results are achieved when the residence time is less than $5.10^{-1}$, and preferably $10^{-1}$, second.

By adjusting the quantity of make-up fluid and its various parameters it is possible to determine experimentally the conditions for obtaining, after pressure release, fibrils of the desired length.

Applicants have attempted to give a physical explanation for the phenomena which lead, according to the process of the invention, to the formation of discontinuous fibrillated structures of short length.

As has been stated above, the two-phase liquid mixture prior to abrupt pressure release consists of droplets or bubbles of solution with a high concentration of polymer emulsified in a material consisting of a continuous solution with a low concentration of polymer.

According to known processes, during the abrupt pressure release of the two-phase liquid mixture, these droplets or bubbles each cause the formation of a fibrillated structure due to the abrupt vaporization of their solvent and these different structures weld together to give the continuous structure or fibrillated roving already known.

Applicants therefore think that the injection of a make-up fluid into this two-phase mixture prior to the pressure release being complete probably has the effect of increasing the distance separating the droplets or bubbles suspended in the dilute phase, and in this way creating a certain heterogeneity inside the mixture consisting of two liquid phases and leading to a subsequent pressure release of an intermittent nature bringing about discontinuities in the fibrillated structure produced.

However, it is possible that a more thorough study of the phenomena would subsequently lead to a different explanation.

In any case it is obvious that the explanation put forward cannot in any way influence the value of the present invention.

As has been stated, in order to carry out the process according to the invention, applicants prefer to bring about the abrupt pressure release of the two-phase mixture by passing it through a die.

This die may be of the same type as those used for the process described in Belgian Pat. No. 568,524 already cited, apart from the fact that it is advisable to provide one or more channels intended for the injection of the make-up fluid.

These channels may open out either upstream of the abrupt pressure release orifice or into the wall of this orifice according to whether it is desired to inject the make-up fluid prior to, or during, the abrupt pressure release of the two-phase liquid mixture.

These channels may be arranged perpendicularly in relation to the direction of flow of the two-phase liquid mixture or they may merely be inclined in relation to this direction.

Furthermore, these channels may be connected normally or tangentially to the pipes containing the two-phase liquid mixture. Applicants have also observed that the tangential injection permits a more energetic agitation and leads generally to better results.

The diameter of the channels for the make-up fluid at the point of injection is of the order of 0.1 to 5 mm.

DESCRIPTION OF THE PREFERRED EMBODIMENTS

Figure 1:
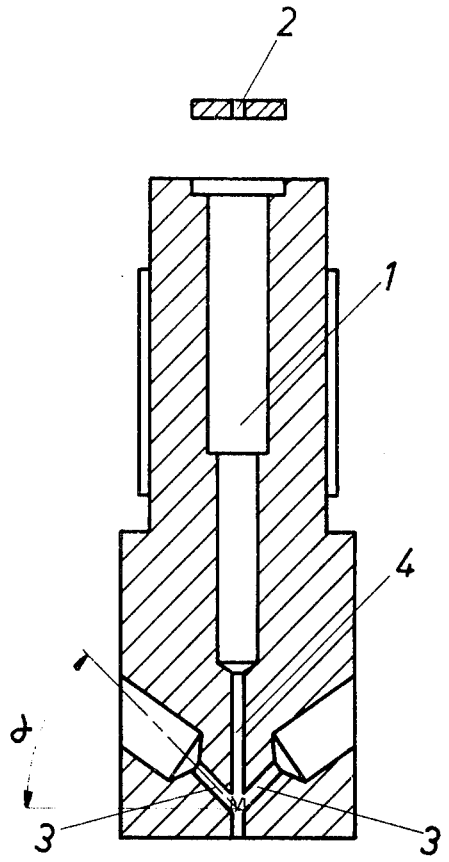
FIG. 1 is a sectional view showing a die used in conjunction with the process according to the invention.

A first example of the process of the invention is carried out with a die of the form shown in FIG. 1.

This die has a prerelease chamber 1 situated after a laminating orifice 2 of a diameter of 1.5 mm, the function of which is to subject the mixture of polymer and solvent to a sufficient load loss to cause the formation of a system with two liquid phases.

Two injection channels 3 for the make-up fluid with a diameter of 1.5 mm open at an angle $\alpha$ of 45° into the abrupt pressure release channel 4. This channel has a length of 16 mm and a diameter of 2 mm.

EXAMPLE 1

Through the laminating orifice 2 there is passed a mixture of ELTEX 56 001 (high-density polyethylene produced by Solvay & Cie., Brussels, Belgium) and methylene chloride. This mixture, which is at a pressure of 48 kg/cm$^2$ and a temperature of 15° C in the prerelease chamber 1, has a polyethylene concentration of 10%. In this chamber the mixture is under conditions which cause the formation of two liquid phases. The flow rate of the feed is 3 kg of polymer per hour.

Through the injection channels 3 there is simultaneously injected nitrogen at a pressure of 50 kg/cm$^2$, at a temperature of 20° C, and at a flow rate of 80 normal m$^3$ per hour.

The abrupt pressure release of the mixture at the end of the channel 4 causes the formation of discontinuous fibrils whose length is of the order of a millimeter and whose specific surface area is of the order of 5 to 6 m$^2$/g. The production of fibrils is 3 kg/hr.

The product obtained is perfectly suitable for the production of non-woven textiles and synthetic papers.

When one gradually reduces the rate of flow of make-up fluid, one observes that the length of the fibrils increases to give finally a continuous fibrillated structure.

Figure 2:
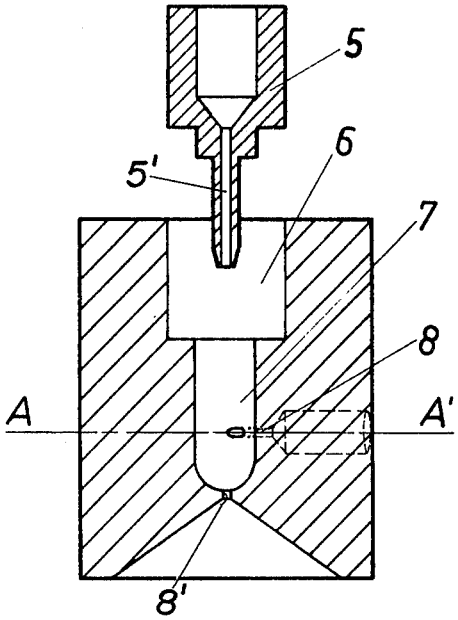
FIG. 2 is an exploded view in sectional elevation of another die which can be used for carrying out the invention.
Figure 3:
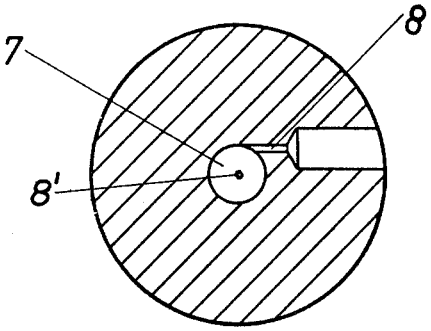
FIG. 3 is a cross-sectional view taken along the line A—A' of FIG. 2.

FIGS. 2 and 3 illustrate another arrangement for carrying out the invention. In order to show the details of the device more clearly, the injection nozzle 5 for the make-up fluid is shown outside its housing 6 in the die. The orifice of the injection channel 5' has a diameter of 1 mm.

The die contains a prerelease chamber 7 with a diameter of 5 mm in which the mixture of polymer and solvent is injected tangentially by a prerelease orifice 8 having a diameter of 1.5 mm. The abrupt release orifice 8' has a length and a diameter of 1 mm.

EXAMPLE 2

In the device of FIG. 2, a mixture identical to that of Example 1 is passed through the die in such a way that in the prerelease chamber 7 it is under the same conditions of pressure and temperature as in Example 1. The flow rate is 5 kg/hr of polymer.

Through the nozzle 5 there is continuously injected, at a flow rate of 35 normal m$^3$ per hour, nitrogen under a pressure of 50 kg/cm$^2$ and at a temperature of 20° C.

The abrupt pressure release of the mixture at the lower end of the die causes the formation of discontinuous fibrils, the length of which varies from 1 to 10 mm and the specific surface area of which is of the order of 7 m$^2$ per gram.

Figure 4:
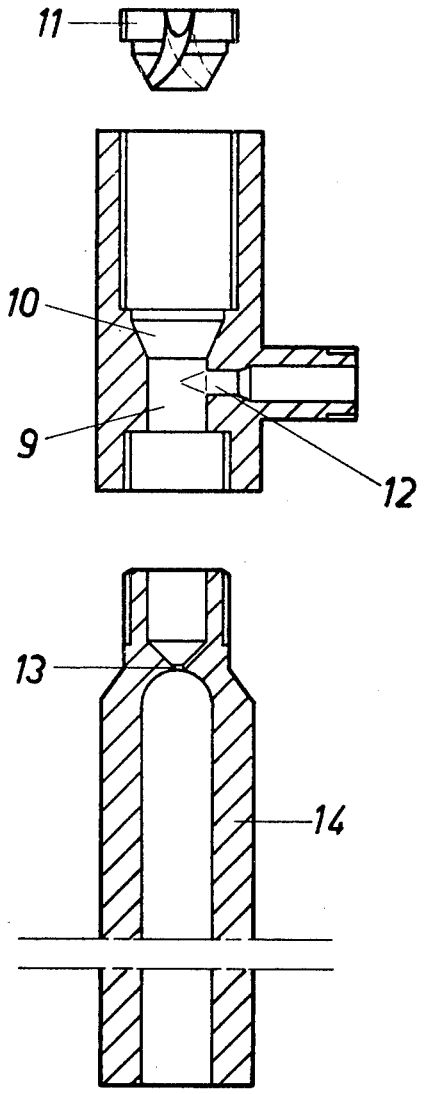
FIG. 4 shows another form of die in an exploded elevational, sectional view.

FIG. 4 shows another embodiment of a die for carrying out the invention. For reasons of clarity, the various components which make up the die are shown in exploded form.

As can be seen in FIG. 4, the die has a prerelease chamber 9 provided with a housing 20 intended to receive a deflector 11 which has the effect of causing a turbulent movement in the two-phase liquid mixture prior to the injection of the make-up fluid.

This chamber 9 is connected tangentially to a pipe 12, with a diameter of 4 mm, for the injection of make-up fluid.

Underneath the prerelease chamber 9 there is the abrupt release orifice 13, which has a diameter of 2 mm and a length of 1 mm. This orifice may be replaced if desired by a valve with adjustable aperture.

The die is extended by an acceleration and shredding channel 14 of a length of 20 cm and a diameter of 10 mm.

The deflector 11 may impart to the two-phase liquid mixture either a turbulent movement in the same direction as that caused by the tangential injection of the make-up fluid, or a turbulent movement in the opposite direction.

EXAMPLE 3

In the device of FIG. 4, a mixture of ELTEX 54 001 and hexane of technical quality "polymerization grade" at a temperature of 190° C and with a concentration of 180 g of polymer per kg of mixture is passed through the die. The pressure of this mixture is regulated so that its pressure in the prerelease chamber is 40 kg/cm$^2$, at which pressure this mixture presents two liquid phases.

Through the channel 12 one injects at the same time at a flow rate of 240 liters per hour water under a pressure of 42 kg/cm$^2$ and at a temperature of 190° C.

By operating under these conditions, there is obtained 25 kg per hour of fibrils having a length of 10 mm and a specific surface area of 15 m$^2$/g.

EXAMPLE 4

Use is made of a die identical with that described in Example 1. Through the laminating orifice 2 there is passed a mixture of SOLVIC 228 (a product of Solvay & Cie., Brussels, Belgium, composed of polyvinyl chloride produced by polymerization in suspension) and dichlorethane, the polyvinyl chloride being stabilized by means of IRGASTAB 17 MO (tin-based stabilizer produced by CIBA-GEIGY). This mixture which, in the prerelease chamber in is at a pressure of 70 kg/cm$^2$ and at a temperature of 165° C, has a concentration of 150 g of polymer per kg of solution. In this chamber, the mixture is present under conditions provoking the formation of two liquid phases. The supply rate is 30 kg of polymer per hour.

Via the channels 3, nitrogen is simultaneously injected at a pressure of 70 kg/cm$^2$ and at a temperature of 25° C at a flow rate of 50 normal m$^3$ per hour.

The abrupt pressure release of the mixture at the end of the channel 4 provokes the formation of discontinuous fibrils having a length of the order of 5 mm and a specific surface area of the order of 5–10 m$^2$ per gram. The rate of production of fibrils is 30 kg per hour.

EXAMPLE 5

A die is used which is identical with that described in Example 2. Through the orifice 8 there is injected a mixture of SOLVIC 228 stabilized by IRGASTAB 17 MO and dichlorethane. This mixture which, in the prerelease chamber 7, is at a pressure of 70 kg/cm$^2$ and a temperature of 170° C, has a concentration of 200 g of polymer per kg of solution. The flow rate is 45 kg of polymer per hour.

Via the nozzle 5 is simultaneously and continuously injected dichlorethane heated to 170° C and under a hydraulic pressure of 70 kg/cm$^2$, the flow rate being 300 liters per hour.

The abrupt pressure release at the extremity of the die provokes the formation of discontinuous fibrils having a length which varies between 5 and 15 mm and a specific surface area which varies between 5 and 10 m$^2$ per gram. The rate of production of fibrils is 45 kg per hour.

EXAMPLE 6

Use is made of a die identical with that described in Example 3.

A mixture of polyvinylidene fluoride and methylene chloride at a temperature of 180° C and a concentration of 100 g of resin per kg of solution is passed through this die. The pressure of this mixture is regulated so that its pressure in the prerelease chamber is 35 kg/cm$^2$, at which pressure this mixture presents two liquid phases. The rate of delivery is 5 kg of resin per hour.

Through the channel 12 there is simultaneously injected nitrogen at a flow rate of 20 normal m$^3$ per hour, the nitrogen being at 20° C and under a pressure of 40 kg/cm$^2$.

By operating under these conditions, there is obtained 5 kg of fibrils per hour, the fibrils having a length of less than or equal to 5 mm and a specific surface area of 15 m$^2$/g.

It will be understood that the above description of the present invention is susceptible to various modifications, changes and adaptations and the same are intended to be comprehended within the meaning and range of equivalents of the appended claims.

We claim:

1. In a process for the manufacture of a fibrillated structure by the abrupt pressure release of a liquid mixture of molten polymer and solvent which is at a temperature and pressure such as to be in the form of a system of two phases consisting of a continuous liquid phase, which is poor in polymer and a second liquid phase dispersed therein which is rich in polymer, the abrupt pressure release taking place in a device which creates high losses and bringing about the instantaneous vaporization of the solvent and the solidification of the said polymer normally in the form of a continuous fibrillated structure, the improvement which comprises introducing a diluent fluid into the two-phase liquid mixture in the device before the pressure release is completed so that the abrupt pressure release results in the production of discontinuous fibrils instead of a continuous fibrillated structure.

2. A process as defined in claim 1, wherein the diluent fluid is introduced into the two-phase liquid mixture before the abrupt pressure release of the latter.

3. A process as defined in claim 1, wherein the diluent fluid is a gas.

4. A process as defined in claim 3, wherein the diluent fluid is nitrogen.

5. A process as defined in claim 1, wherein the diluent fluid is a vapor.

6. A process as defined in claim 5, wherein the diluent fluid is water vapor.

7. A process as defined in claim 1, wherein the diluent fluid is a liquid.

8. A process as defined in claim 7, wherein the diluent fluid is water under pressure.

9. A process as defined in claim 8, wherein the diluent fluid contains a wetting agent.

10. A process as defined in claim 1, wherein the diluent fluid is identical with the solvent used for making the two-phase liquid mixture to be released abruptly.

11. A process as defined in claim 1, wherein the diluent fluid is at a temperature between 20° C and its boiling point at the pressure at which it is injected into the two-phase liquid mixture.

12. A process as defined in claim 1, wherein the ratio between the volume of diluent fluid introduced and the volume of two-phase liquid mixture is from 0.3 to 10.

13. A process as defined in claim 1, wherein the polymer is selected from the group consisting of polyolefins, polyamides, polyesters, polyurethanes, polycarbonates, vinyl and acrylic polymers.

* * * * *